United States Patent [19]

Antonious

[11] Patent Number: 4,655,459

[45] Date of Patent: Apr. 7, 1987

[54] GOLF CLUB HEAD

[76] Inventor: Anthony J. Antonious, 205 E. Joppa Rd., Towson, Md. 21204

[21] Appl. No.: 804,394

[22] Filed: Dec. 4, 1985

[51] Int. Cl.[4] ..... A63B 53/04

[52] U.S. Cl. ..... 273/171; 273/167 H

[58] Field of Search ..... 273/169, 171, 80 A, 273/167 F, 172, 170, 173, 174, 175, 168, 78, 167 H, 167 A; D21/217, 218, 219

[56] References Cited

U.S. PATENT DOCUMENTS

| | | | |
|---|---|---|---|
| 1,901,562 | 3/1933 | Main | 273/169 |
| 2,517,245 | 8/1950 | Scott | 273/171 |
| 3,692,306 | 9/1972 | Glover | 273/171 X |
| 3,961,796 | 6/1976 | Thompson | 273/171 X |
| 4,043,563 | 8/1977 | Churchward | 273/171 |
| 4,423,874 | 1/1984 | Stuff | 273/171 |
| 4,580,784 | 4/1986 | Brill | 273/162 E |

*Primary Examiner*—George J. Marlo
*Attorney, Agent, or Firm*—Nicholas J. Aquilino

[57] ABSTRACT

An improved putter-type golf club head configuration including a heel, toe, upper surface, bottom surface, rear surface and ball striking face having a center of percussion centrally located thereon wherein the improvement includes a first cavity located in the upper surface of the club head behind the ball striking face and generally symmetrical around the center of percussion and second and third cavities located in the bottom surface of the club head adjacent the heel and toe respectively. The club head configuration provides a unique improved weight distribution having weight centrally located below and behind the ball striking face and weight located at the toe and heel of the club vertically above the center of percussion.

4 Claims, 14 Drawing Figures

GOLF CLUB HEAD

BACKGROUND OF THE INVENTION

The present invention relates to golf club head designs, and in particular, to a golf club head design having a unique structure and corresponding weight distribution.

It is well known that optimum results are achieved in striking a golf ball when it is struck at the center of percussion of the golf club head. Although the golf club head has only a single point representing the center of percussion, various attempts to minimize off-center hits of a golf ball have been provided in the prior art. Most of these golf club head structures distribute the weight of the golf club head to the outside or peripheral edges in an attempt to minimize the torque produced by the off-center hit. For example, heel-toe weighted golf clubs have the mass of the golf club head concentrated at both the heel and toe with the center of percussion in the center.

BRIEF DESCRIPTION OF THE INVENTION

The present invention provides a golf club head structure having a cavity in the upper surface of the club head centrally located behind the center of percussion and two smaller cavities located in the bottom surface of the club head at the heel and toe. This arrangement provides a weight distribution wherein significant mass of the body of the club head is provided centrally aligned with and positioned below the center of percussion of the golf club head. Additional mass of the golf club head is provided at the toe and heel to provide additional weighting at the peripheral ends of the club head. This arrangement provides a new and unique weight distribution system which counteracts the effects of torque when a golf ball is struck off the center of percussion by the club head.

Among the objects of the present invention are the provision of a putter-type golf club head having a unique weight distribution wherein the mass of the club head is concentrated above the center of percussion at the heel and toe portions of the club head and concentrated below the center of percussion toward the center of the club head.

DESCRIPTION OF THE PREFERRED EMBODIMENTS

Figure 1:
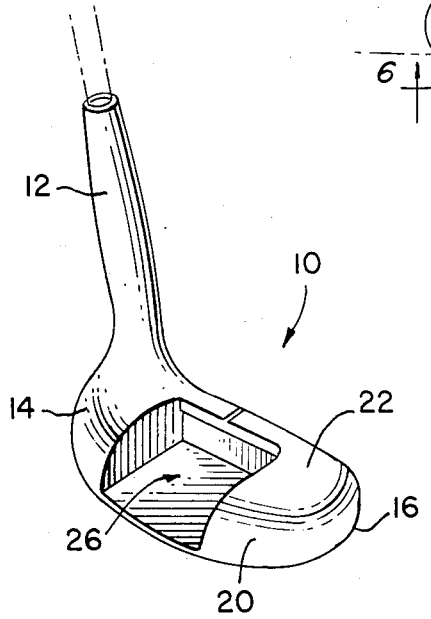
FIG. 1 is a perspective view of the golf club head of the present invention.
Figure 2:
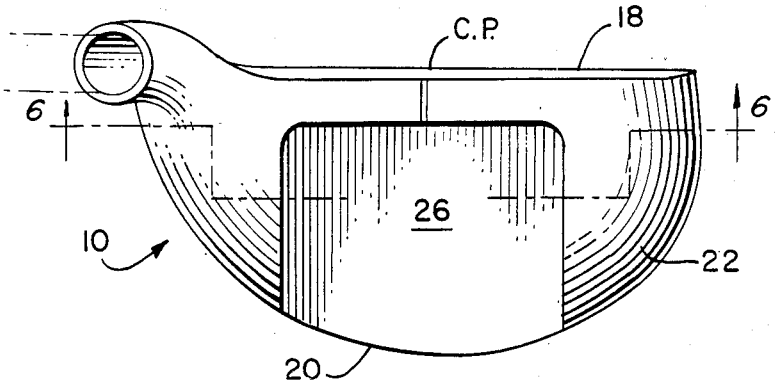
FIG. 2 is a top plan view of FIG. 1.

As illustrated in the drawings, the golf club head configuration having the unique weight distribution system is particularly adapted with use for putters. FIGS. 1 to 6 show one embodiment of a golf club putter head 10 of the present invention including a hosel 12, heel 14, toe 16, ball striking face 18, rear surface 20, upper surface 22 and bottom surface 24. In this regard, the putter head 10 is of a conventional design. In the embodiment of FIGS. 1 to 6, the putter head 10 is a mallet head type. In keeping with the invention, the putter head includes a cavity 26 in the upper surface 22 and positioned behind the ball striking face 18 toward the rear surface 20 of the putter head 10. Preferably, the cavity would be designed to be symmetrical about the center of percussion 28 on the club head which is centrally located on the ball striking face 18. The cavity 26 is formed by side walls 30 and 32 and a lower flange 34. This flange which forms part of the mass of the club head, serves as a weight at this point and the center of the flange 34 is positioned in a line perpendicular to and below the center of percussion 28 on the ball striking face.

Figure 3:
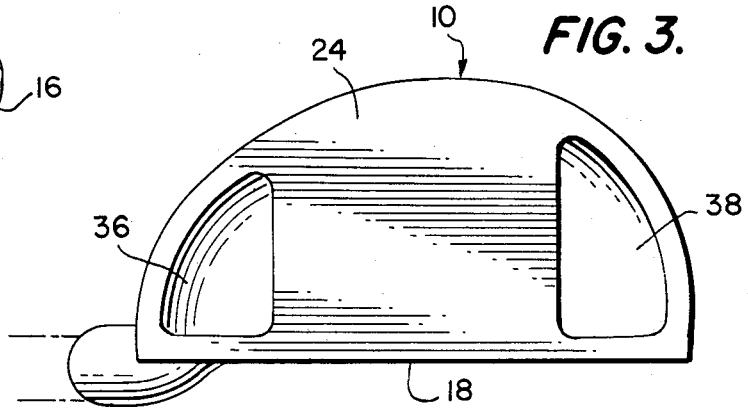
FIG. 3 is a bottom view of FIG. 1.
Figure 5:
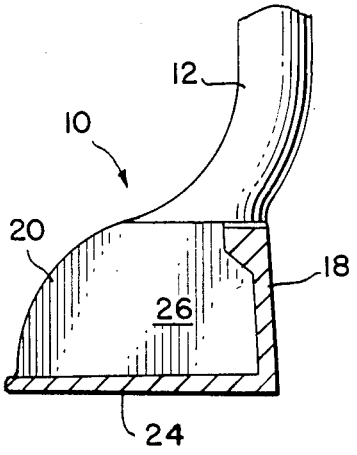
FIG. 5 is an end sectional view taken along lines 5—5 of FIG. 4.
Figure 4:
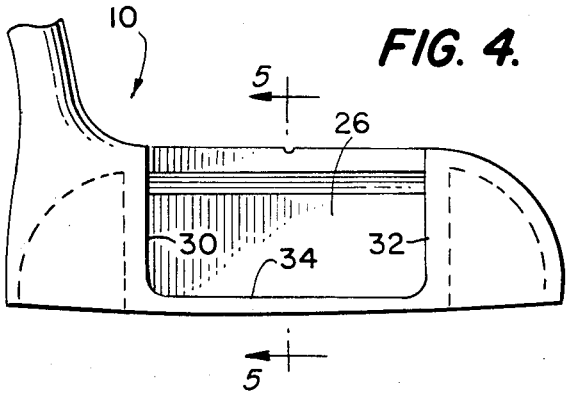
FIG. 4 is a rear elevational view of FIG. 1.
Figure 6:
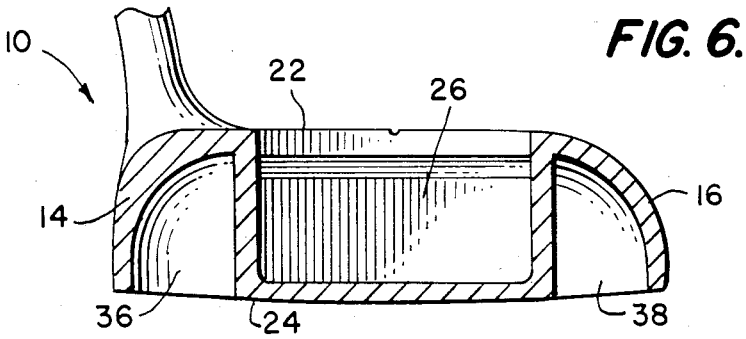
FIG. 6 is a rear sectional view taken along lines 6—6 of FIG. 2.

As illustrated in FIG. 3, the bottom surface of the putter head 10 includes an additional cavity 36 under the heel 14 of the putter head and a second additional cavity 38 under the toe 16 of the putter head. The cavities 36 and 38 extend upwardly from the bottom surface of the putter head to a point near the upper surface 22. This structure provides a mass of the club head concentrated at the heel and toe portions, respectively, and toward the upper surface 22 of the club head above the center of percussion 28 on the ball striking face 18. Thus it can be seen from the drawing that the improved putter head 10 has three cavities located within its surfaces. A single cavity is located in the upper surface toward the center of the club head and two cavities are located in the bottom surface of the club head adjacent the heel and toe portions of the club head 10.

By way of example, a golf club putter head of the type shown in FIGS. 1 to 7 would normally be approximately four inches long. The upper surface cavity could be approximately one and one-half inches to two inches long by five eighths to one inch deep and is positioned midway between the ends of the heel 14 and toe 16. The bottom surface cavity 36 and 38 are each approximately one-half to one inch long and approximately one-half inch deep.

Figure 7:
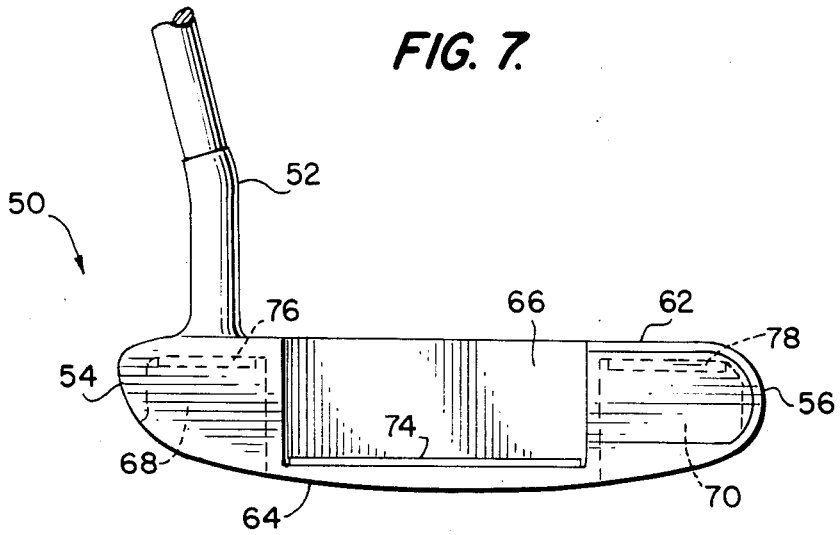
FIG. 7 is a rear elevational view of another embodiment of the golf club head of the present invention.
Figure 8:
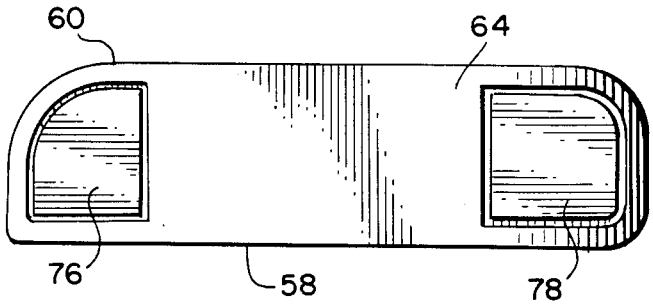
FIG. 8 is a bottom view of FIG. 7.

FIGS. 7 and 8 illustrate another embodiment of a golf club head 50 of the heel-toe type configuration having a weight distribution in accordance with the present invention. The club head 50 includes a hosel 52, heel 54, toe 56, ball striking face 58, rear surface 60, upper surface 62 and bottom surface 64. The club head 50 includes a rearwardly disposed cavity 66 formed into the upper surface 62 of the club head. The club head 50 also includes a cavity 68 under the heel 54 and a cavity 70 under the toe 56. In this embodiment, an additional weight 74 is provided in the cavity 66 disposed vertically below the center of percussion 72 of the club head 50. Additional weights 76 and 78 are also provided on the upper surfaces of the cavities 68 and 70 vertically above the center of percussion 72 of the club head 50.

The additional weights 74, 76 and 78 further distribute the weight of the club head in accordance with the present invention. This weight distributing structure locates the weight in the center of the club head 50 below the center of percussion 72 on the ball striking face 58 and the weight at the heel 54 and toe 56 above the center of percussion 72.

Figure 9:
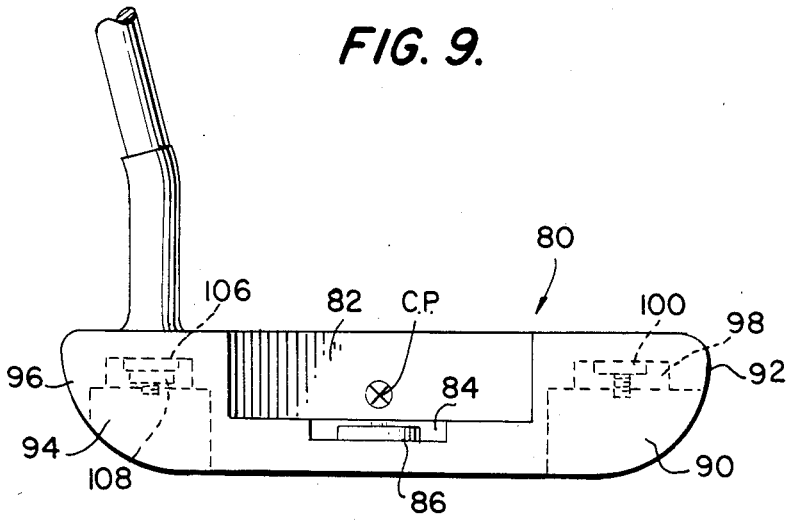
FIG. 9 is a rear elevational view of a further embodiment of the golf club head of the present invention.
Figure 10:
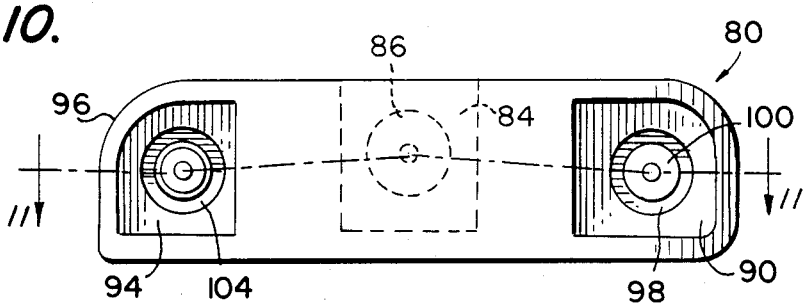
FIG. 10 is a bottom view of FIG. 9.
Figure 11:
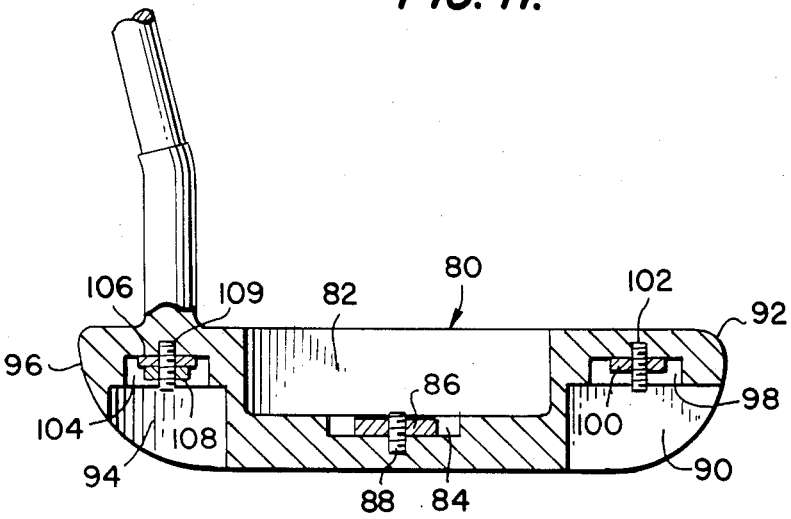
FIG. 11 is a rear sectional view taken along the lines 11—11 of FIG. 10.

FIGS. 9, 10 and 11 illustrate a further embodiment of a golf club head 80 of the heel-toe type configuration illustrated in FIGS. 7 and 8. In this embodiment, the rearwardly disposed cavity 82 includes a second smaller cavity 84 on the bottom thereof adapted to accommodate a weight 86 which as shown in FIG. 11 is preferably mounted on a threaded stud 88 centrally disposed within the cavity 84. As with the embodiment shown in FIGS. 7 and 8, the golf club head 80 includes a cavity 90 near the toe 92 of the club head 80 and a second cavity 94 near the heel 96 of the club head 80. The cavity 90 is provided with a smaller cavity 98 which accommodates a weight 100 which is also removeably mounted on a threaded stud 102. The cavity 94 is provided with a second smaller cavity 104 provided with two weights 106 and 108 threadably mounted upon a stud 109.

In this embodiment, the weight distribution of the golf club 82 may be finely and precisely controlled by interchanging the weights mounted on the threaded studs. It will be appreciated that various sizes of weights may be used, and also a plurality of weights may be used instead of a single weight as shown with respect to the weights 106 and 108 in the heel cavity 94. In this embodiment, like the embodiments previously described, the weights at the heel and toe ends of the club head 80 are disposed above the center of percussion 110 of the golf club head 80, whereas the weight 86, directly in line with the center of percussion 110 is disposed below the center of percussion.

Figure 12:
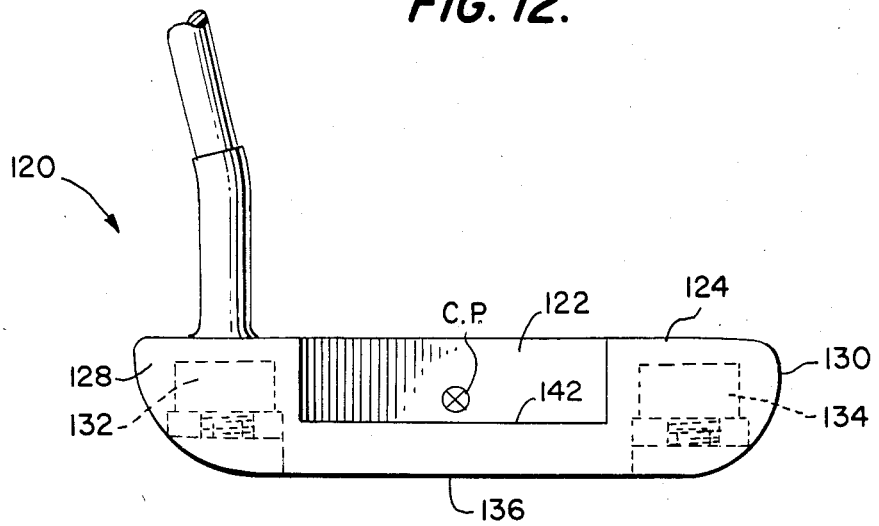
FIG. 12 is a rear elevational view of still another embodiment of the golf club head of the present invention.
Figure 13:
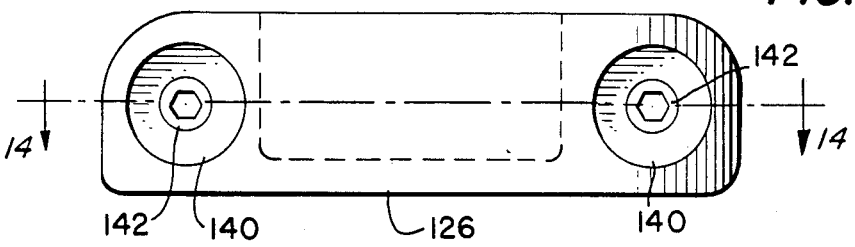
FIG. 13 is a bottom view of FIG. 12.
Figure 14:
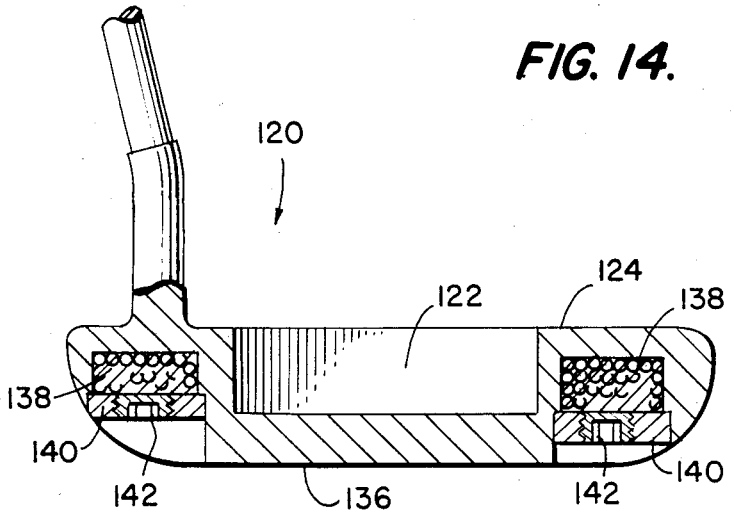
FIG. 14 is a rear sectional view taken along the lines 14—14 of FIG. 10.

FIGS. 12, 13 and 14 illustrate still another embodiment of a golf club head 120 of the present invention having a heel-toe type configuration. In this embodiment, a cavity 122 is provided in the top surface 124 of the club head 128 behind the ball striking face 126. The heel 128 and toe 130 are each provided with cavities 132 and 134 on the bottom surface 136 of the club head 120. The cavities 132 and 134 are adapted to accommodate particulate weighting material such as lead powder or lead shot 138. Each cavity is sealed by a plate 140 having a small opening sealed by a machine screw 142.

In this embodiment, the weight distribution of the golf club head 120 may be precisely controlled by regulating the amount of particulate weighting material which is placed in each of the cavities 132 and 134. In this embodiment, like the embodiments described hereinabove, the weight at the heel and toe ends of the golf club head 120 are disposed above the center of percussion 140 of the golf club head 120 whereas the weight directly in line with the center of percussion formed by the mass of material between the bottom surface 136 of the club head and bottom 142 of the cavity 122 is below the center of percussion.

It will be appreciated that the above description is illustrative only and that many modifications may be made in the size and shape of the golf club head. For example, the cavities in the upper and lower surface of the club head may be bigger and/or smaller than those illustrated in the drawings. The cavities may also be closed or formed integrally within the body of the golf club head and still keep within the scope of the present invention. Also, additional weights may be placed in various places on the club head in keeping within the scope of the invention as defined by the following claims.

What I claim is:

1. A golf club head having a heel, center, toe, upper surface, bottom surface, rear surface, and ball striking face; wherein the improvement comprises:

a mass distribution means, including a first mass adjacent said bottom surface at said center of said golf club head between said heel and said toe, said first mass being further defined by a first cavity in said upper surface located between said heel and said toe and behind said ball striking face and extending downwardly from said upper surface; a second mass adjacent said upper surface in said toe of said club head, said second mass being further defined by a second cavity located in said bottom surface and in said heel of said golf club head and extending upwardly from said bottom surface into said club head; and a third mass adjacent said upper surface in said heel of said club head, said third means being further defined by a third cavity located in said bottom surface and in said toe of said club head and extending upwardly from said bottom surface into said club head, said first mass in said bottom surface being below a plane parallel to said bottom surface and perpendicular to said ball striking face and extending through said center of percussion on said ball striking face; and said second and third masses adjacent said upper surface being above said plane, whereby said masses are concentrated above said center of percussion of the heel and toe locations of said club head and below said center of percussion at the central portion of said club head.

2. The golf club head of claim 1 wherein said masses further include weights attachable to said club head at each of said mass locations.

3. The golf club head of claim 2 wherein said weights are discs and said club head further include mounting means to receive said discs.

4. The golf club head of claim 2 wherein said weights are formed by particulate material and said club head further includes means for maintaining said particulate material on said club head.

* * * * *

UNITED STATES PATENT AND TRADEMARK OFFICE

CERTIFICATE OF CORRECTION

PATENT NO. : 4,655,459

DATED : April 7, 1987

INVENTOR(S) : Anthony J. Antonious

It is certified that error appears in the above-identified patent and that said Letters Patent is hereby corrected as shown below:

Column 4, line 29, change "heel" to -- toe --.

Column 4, line 34, change "toe" to --heel--.

Signed and Sealed this

Fourth Day of July, 1989

*Attest:*

*Attesting Officer*

DONALD J. QUIGG

*Commissioner of Patents and Trademarks*